US008022898B2

(12) United States Patent
Kang et al.

(10) Patent No.: US 8,022,898 B2
(45) Date of Patent: Sep. 20, 2011

(54) FLAT PANEL DISPLAY DEVICE

(75) Inventors: Tae-Wook Kang, Suwon-si (KR); Chang-Yong Jeong, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 930 days.

(21) Appl. No.: 11/117,666

(22) Filed: Apr. 29, 2005

(65) Prior Publication Data

US 2005/0258771 A1 Nov. 24, 2005

(30) Foreign Application Priority Data

May 20, 2004 (KR) ..... 10-2004-0035867

(51) Int. Cl.
*G09G 3/30* (2006.01)

(52) U.S. Cl. ..... 345/76

(58) Field of Classification Search ..... 345/76–81
See application file for complete search history.

(56) References Cited

U.S. PATENT DOCUMENTS 4,904,989 A * 2/1990 Matsui et al. ..... 345/76
6,714,178 B2 * 3/2004 Koyama et al. ..... 345/76
2002/0158835 A1 10/2002 Kobayashi et al.
2003/0076046 A1 4/2003 Komiya et al.
2004/0090400 A1 * 5/2004 Yoo ..... 345/76

FOREIGN PATENT DOCUMENTS

JP 2002-032037 1/2002
JP 2002-318553 10/2002
JP 2003-308031 10/2003
JP 2004-139970 5/2004

OTHER PUBLICATIONS

Chinese Office Action dated Jul. 11, 2008.

* cited by examiner

*Primary Examiner* — Alexander Eisen
*Assistant Examiner* — Cory Almeida
(74) *Attorney, Agent, or Firm* — H.C. Park & Associates, PLC

(57) ABSTRACT

Provided is a flat display device having a display region in which more than one thin film transistor and more than one pixel are included. The device includes a driving line that supplies driving power to the display region, and an auxiliary driving line, which is coupled with the driving line, is formed in a different layer from the driving line. The driving line may be an identical layer to the source/drain electrodes of the display region.

17 Claims, 13 Drawing Sheets

FLAT PANEL DISPLAY DEVICE

CROSS REFERENCE TO RELATED APPLICATION

This application claims priority to and the benefit of Korean Patent Application No. 10-2004-0035867, filed on May 20, 2004, which is hereby incorporated by reference for all purposes as if fully set forth herein.

BACKGROUND OF THE INVENTION

1. Field of the Invention

The present invention relates to a flat panel display device, and more particularly, to a flat panel display device that may have an increased screen aperture and that may prevent brightness non-uniformity due to a voltage drop in a display region.

2. Discussion of the Background

Recently, various flat display devices have been developed to replace the conventional cathode ray tube (CRT). Generally, flat panel display devices are either emissive or non-emissive types. Emissive types include flat CRTs, plasma display panels, vacuum fluorescent displays, field emission displays, and inorganic/organic electro-luminescent (EL) displays, and non-emissive types include liquid crystal displays. The organic EL displays have drawn attention since they do not require a light source, such as a back light, and they may operate with low power consumption and high efficiency.

The organic EL display device emits light having a specific wavelength by energy generated from exitons, which are formed by electrons and holes that are injected through an anode and a cathode and recombine in an organic thin film. The organic EL display device is capable of operating with a low voltage, is thin and light, and has a wide viewing angle and a quick response time.

An organic EL unit of the organic EL display device may include a first electrode (an anode) formed in a stacking type on a substrate, an organic EL layer, and a second electrode (a cathode). The organic EL layer comprises an organic emitting layer (EML) that emits light by forming exitons. To increase the light emission efficiency, electrons and holes must be transferred to the organic EML. Hence, an electron transport layer (ETL) may be disposed between the cathode and the organic emitting layer, and a hole transport layer (HTL) may be disposed between the anode and the organic emitting layer. Also, a hole injection layer (HIL) may be disposed between the anode and the HTL, and an electron injection layer (EIL) may be disposed between the cathode and the ETL.

The organic EL display device may be a passive matrix (PM) or active matrix (AM) type according to its driving method. In the PM type, the anode and the cathode may be simply arranged in columns and rows, respectively, and a row driving circuit supplies scanning signals to the cathode one row at a time. Also, a column driving circuit supplies data signals to each pixel. On the other hand, the AM type controls signals inputted to each pixel using a thin film transistor (TFT) and is widely used for displaying animations since it may process a large number of signals.

However, in an organic/inorganic EL display device, and particularly in an AM type organic/inorganic EL display device, a ratio of a light emitting region to each pixel, that is, a pixel aperture, may be reduced due to the layout of a circuit unit and wirings.

FIG. 1A is a plan view showing a conventional organic EL display device.

The AM type organic EL display device of FIG. 1A has a predetermined display region 20, which includes an organic light emitting diode (OLED) on a transparent substrate 11, and a sealing unit 80 seals a sealing member (not shown), such as a metal cap, to seal the display region 20. The display region 20 comprises a plurality of pixels having an OLED and a TFT. A plurality of driving lines VDD 31 may be disposed in the display region 20. The driving lines 31, which supply power to the display region 20, are coupled with a terminal region 70 through a driving power supply line 32 disposed outside of the display region 20.

FIG. 1B is a magnified picture showing portion "A" of FIG. 1A. Here, the driving lines 31 must be thick and wide enough to prevent a voltage drop from occurring when supplying power to the display region 20. Consequently, the aperture ratio, which is an area ratio of a light emitting region with respect to each of the pixels decreases, which increases the to ratio of a dead space with respect to the overall display region, thereby reducing image quality.

Japanese Patent publication No. 2003-308031 discloses an organic EL display device structure in which power lines and gate lines are disposed parallel to each other to improve brightness. However, the effect of power line width on aperture ratio and the voltage drop problem that may occur with an increased screen size are not addressed.

SUMMARY OF THE INVENTION

The present invention provides an electroluminescent display device structure that may remove or reduce the problem of brightness non-uniformity in a display region due to a voltage drop.

Additional features of the invention will be set forth in the description which follows, and in part will be apparent from the description, or may be learned by practice of the invention.

The present invention discloses a flat display device having a display region including a thin film transistor and a pixel. The device comprises a driving line that supplies driving power to the display region, and an auxiliary driving line, which is coupled with the driving line, is in a different layer from the driving line.

The present invention also discloses an electroluminescent display device having a display region including a thin film transistor and an intermediate layer, the intermediate layer including at least an emission layer being interposed between a first electrode layer and a second electrode layer. The device comprises a driving line that supplies driving power to the display region, and an auxiliary driving line, which is coupled with the driving line. The driving line and the auxiliary driving line are in different layers from each other.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1A:
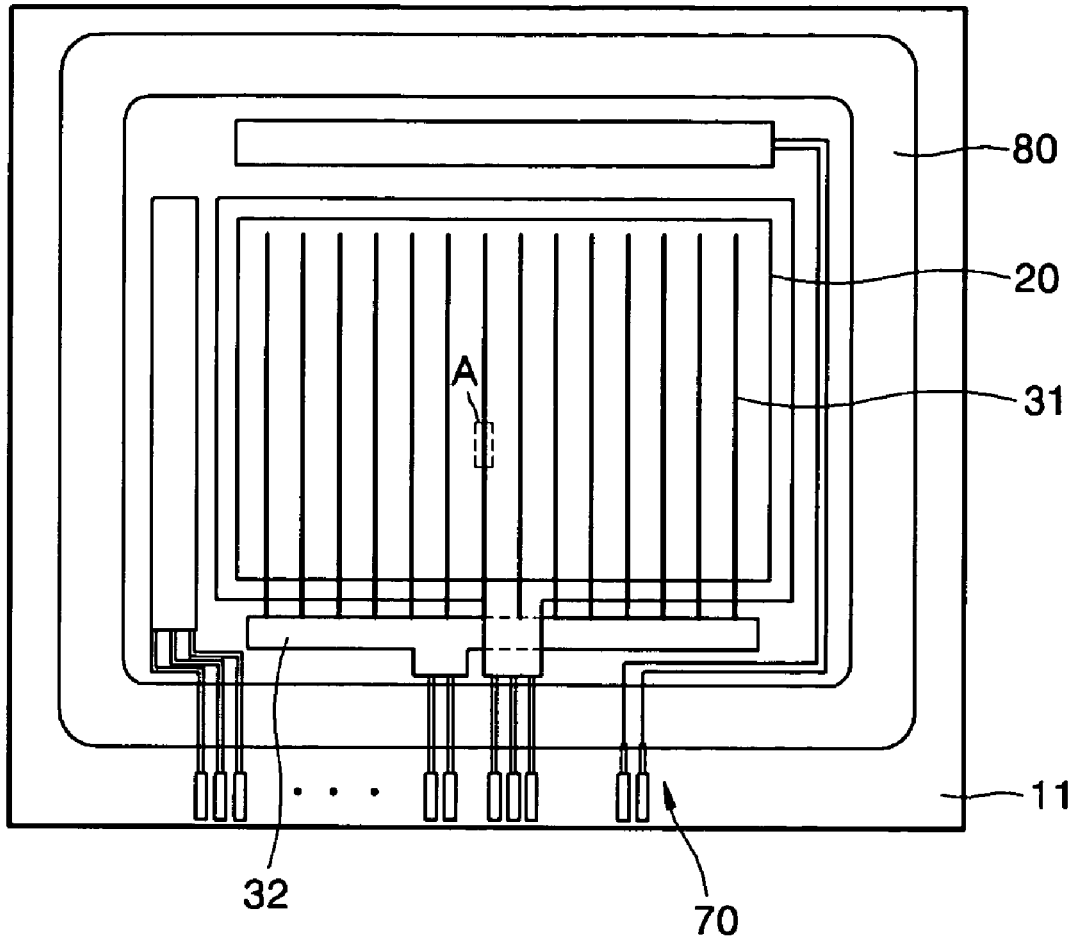
FIG. 1A (PRIOR ART)
FIG. 1A is a plan view showing a conventional organic EL display device.
Figure 1B:
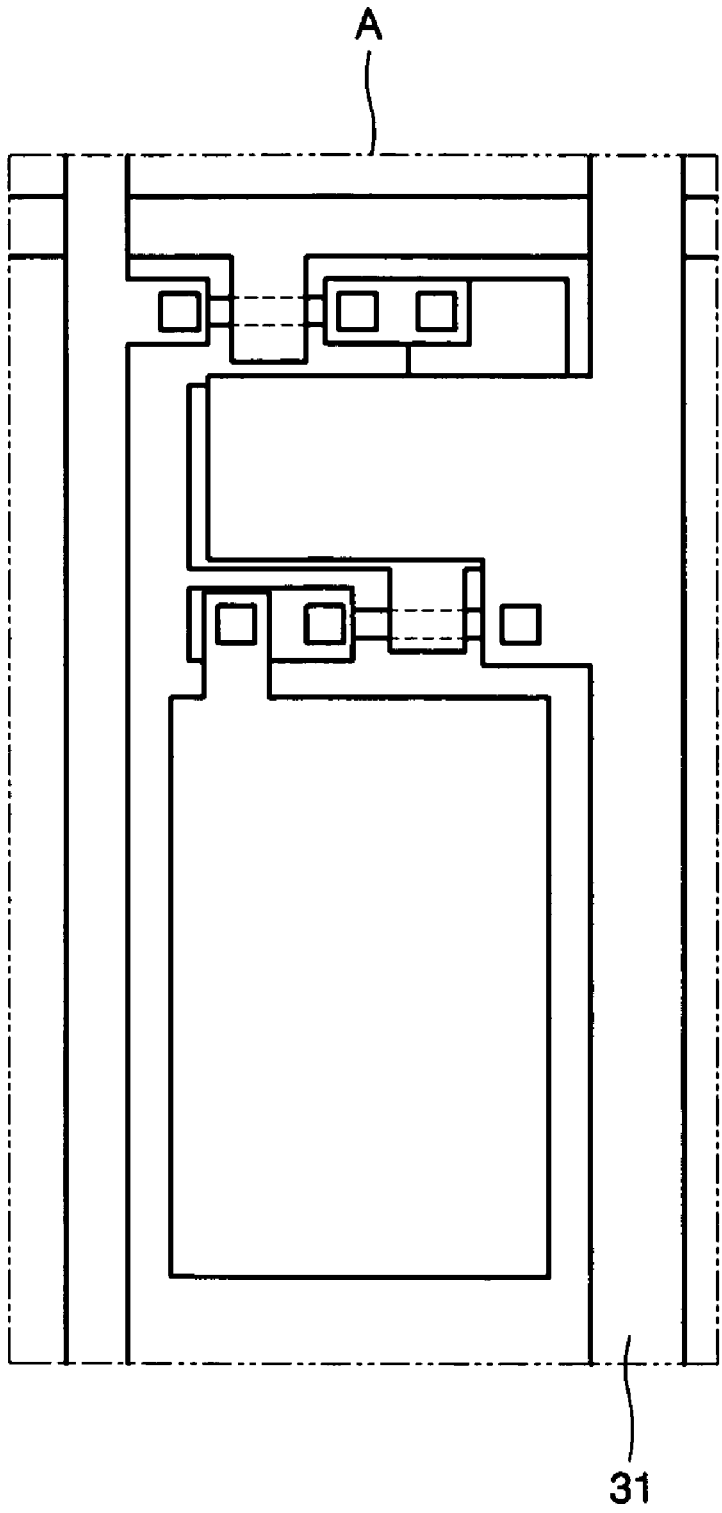
FIG. 1B (PRIOR ART)
FIG. 1B is a magnified view showing the portion "A" of FIG. 1A.
Figure 2A:
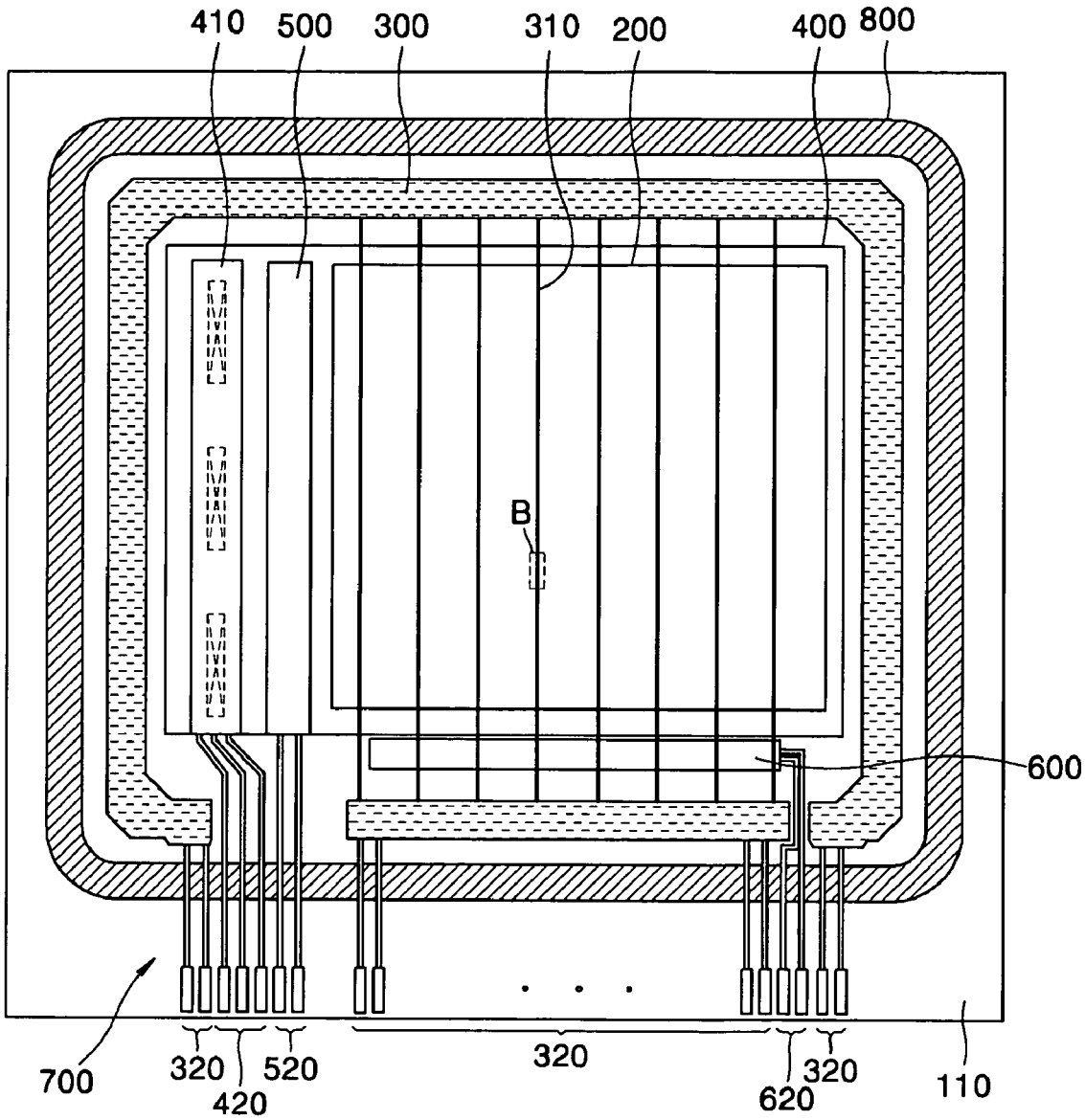
FIG. 2A is a plan view showing an organic EL display device according to an exemplary embodiment of the present invention.

FIG. 2A is a plan view showing an organic EL display device according to an exemplary embodiment of the present invention.

Referring to FIG. 2A, the organic EL display device may include a display region 200 on a surface of the substrate 110, a sealing unit 800 coated along an outer line of the display region 200 to seal the display region 200 within a sealing substrate (not shown) and the substrate 110, and a terminal region 700 on which various terminals are disposed.

A driving power supply line 300 supplies power to the display region 200, and it may disposed between the display region 200 and the sealing unit 800. The driving power supply line 300 may be disposed at other areas, but when formed surrounding the display region 200, it may improve brightness uniformity of the display region by supplying a more uniform driving power to the entire display region.

The driving power supply line 300 is coupled with a driving power line 310. The driving power line 310 may be disposed across the display region 200, and it may be coupled with a source electrode 170*a* disposed under a protection layer 180 (refer to FIG. 2C).

Also, vertical/horizontal driving circuit units 500 and 600 may be disposed outside of the display region 200. The vertical circuit unit 500 may be a scan driving circuit that applies scan signals to the display region 200, and the horizontal driving circuit unit 600 may be a data driving circuit that applies data signals to the display region. The vertical/horizontal driving circuit units 500 and 600 may be disposed outside of the sealing region as an external integrated circuit (IC) or chip on glass (COG) unit.

An electrode power supply line 410, which supplies electrode power to the display region 200, may be disposed outside of the display region 200. It may be coupled with a second electrode layer 400, which is formed on the entire upper part of the display region 200, through via holes in insulating layers formed between the electrode power supply line 410 and the second electrode layer 400.

The driving power supply line 300, the electrode power supply line 410, and the vertical/horizontal driving circuit units 500 and 600 include terminals 320, 420, 520, and 620, respectively, and are coupled with a terminal region 700, disposed outside of the sealing region, through wires.

Figure 2B:
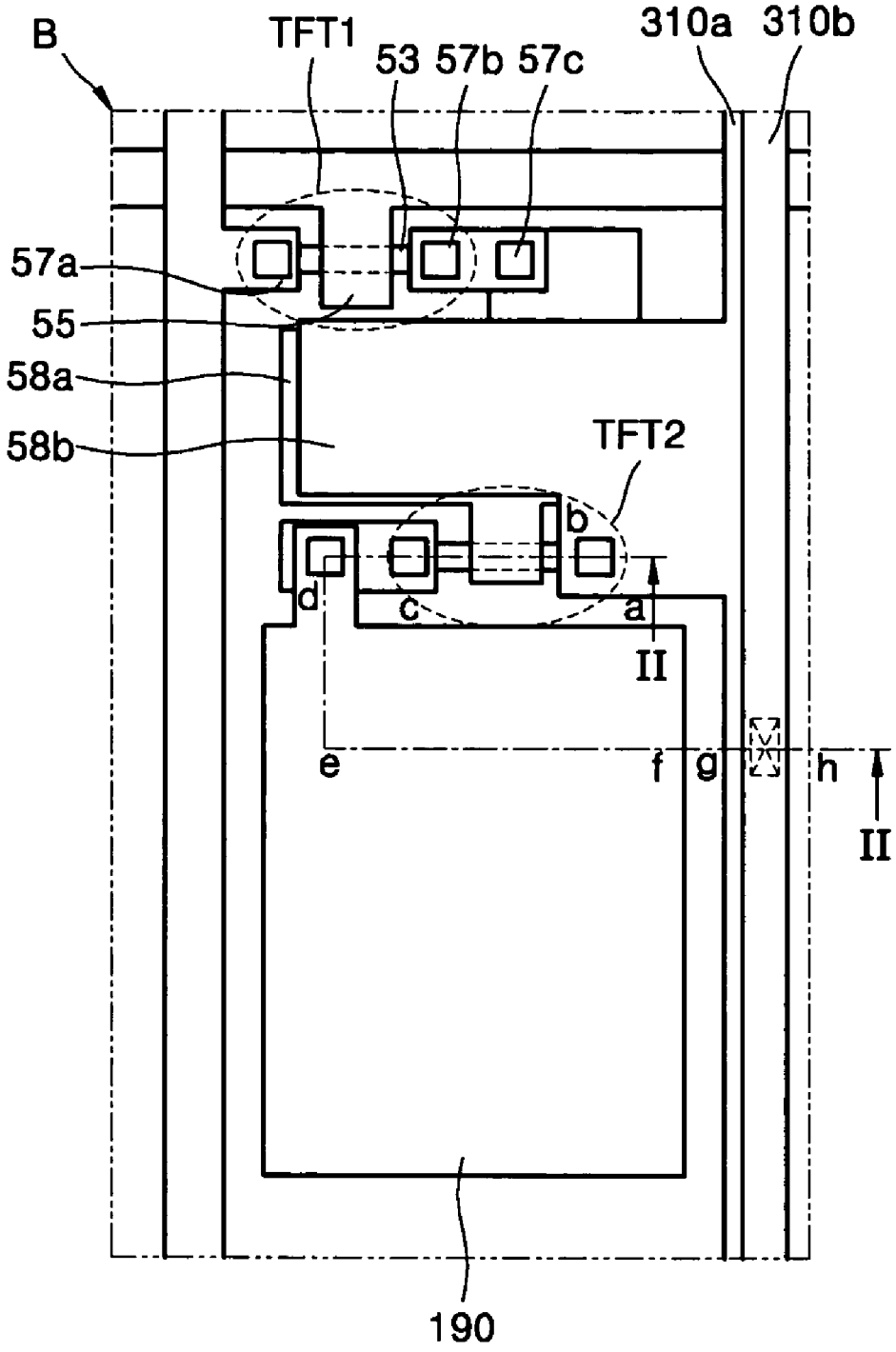
FIG. 2B is a magnified view showing portion "B" of FIG. 2A.

The display region 200 will now be described with reference to FIG. 2B and FIG. 2C, but the sealing substrate and a sealing thin film layer are omitted in the figures for ease of explanation. FIG. 2B, which is a magnified view showing portion "B" of FIG. 2A, shows a pixel of the display region. The pixel includes two top gate type TFTs and one capacitor, but the present invention is not limited to this configuration.

A gate electrode 55 of a first thin film transistor TFT1 extends from a scan line that applies a scan signal. Applying a scan signal to the scan line transmits a data line's data signal from a source electrode 57*a* to a drain electrode 57*b* of the first thin film transistor TFT1 through its semiconductor active layer 53.

An extension unit 57*c* of the drain electrode 57*b* may be coupled with a first end of a first electrode 58*a* of a capacitor, and a second end of the first electrode of the capacitor constitutes a gate electrode 150 (FIG. 2C) of a second thin film transistor TFT2, which is a driving thin film transistor. A second electrode 58*b* of the capacitor is coupled with a driving line 310 (FIG. 2A).

Figure 2C:
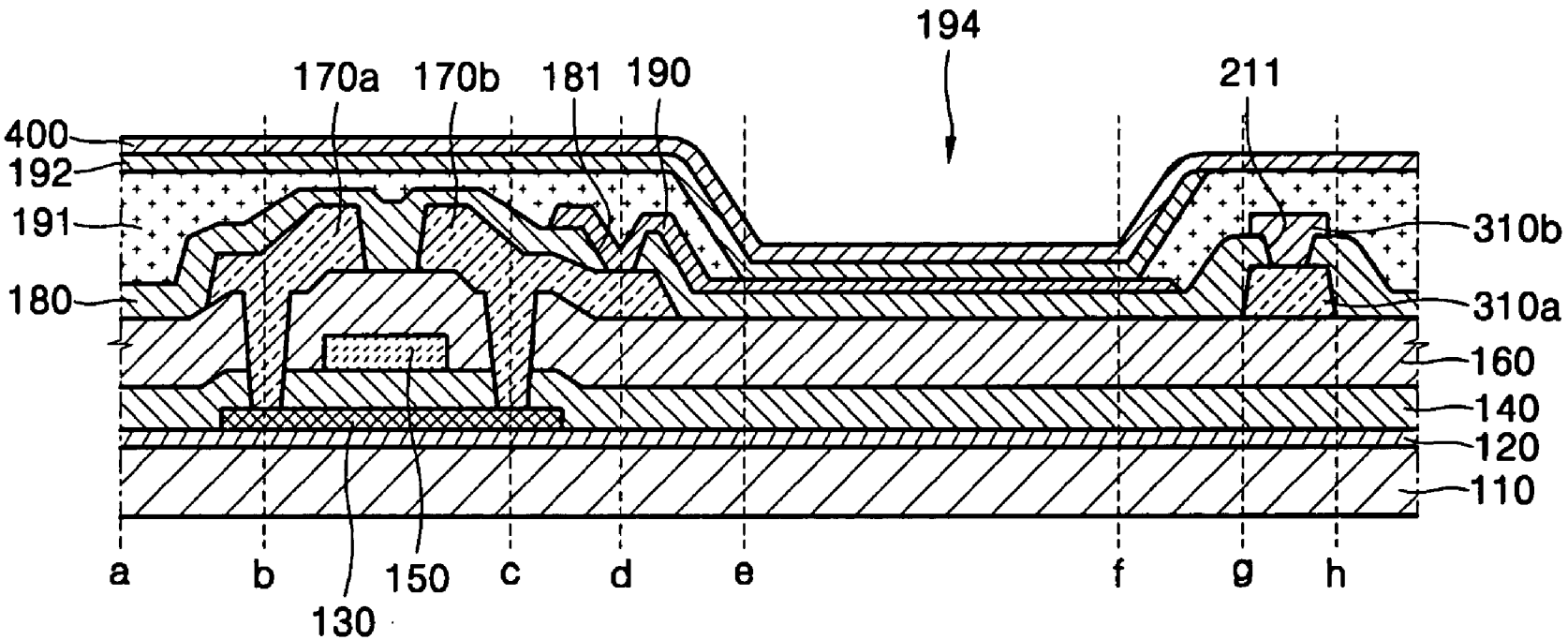
FIG. 2C and FIG. 2D are cross-sectional views taken along line II-II of FIG. 2B.

FIG. 2C is a cross-sectional view taken along line II-II of FIG. 2B. The portion of the FIG. 2C indicated by a-e of line II-II shows the driving thin film transistor TFT2, the portion indicated by e-f shows a pixel aperture 194, and the portion indicated by g-h shows the driving line 310.

As FIG. 2C shows, a semiconductor active layer 130 of the second thin film transistor TFT2 may be formed on a buffer layer 120, which may be formed on a surface of the substrate 110. The semiconductor active layer 130 may be formed of an amorphous or polycrystalline silicon layer. Though not shown in detail, the semiconductor active layer 130 includes source and drain regions doped with an N-type or P-type dopant and a channel region. The semiconductor active layer 130 can be formed of a variety of materials, such as an organic semiconductor.

A gate insulating layer 140 may be formed on the semiconductor active layer 130 and the buffer layer 120, and the gate electrode 150 may be disposed on the gate insulating layer 140 at a position corresponding to the channel region of the semiconductor active layer 130. The gate electrode 150 may be formed of a material, such as MoW and Al, in consideration of contact with a neighboring layer, surface flatness of stacked layers, and process ability, but it is not limited thereto.

An interlayer insulating layer 160 may be formed on the gate electrode 150 and the gate insulating layer 140, and it may be made of a single or multiple layers. Source/drain electrodes 170*a* and 170*b* of the second thin film transistor TFT2 are formed on the interlayer insulating layer 160. The source/drain electrodes 170*a* and 170*b* can be formed of a metal, such as MoW, and they may be heat treated after formation for smooth ohmic contact with the semiconductor active layer 130.

A protection layer 180, which can include a passivation layer and/or a planarizing layer for protecting and/or planarizing layers underneath it, may be formed on the source/drain electrodes 170*a* and 170*b*, and a first electrode layer 190 may be formed on the protection layer 180. The first electrode layer 190 may be coupled with one of the source/drain electrodes 170*a* and 170*b* through a via hole 181 formed in the protection layer 180. FIG. 2C shows the first electrode layer 190 coupled with the drain electrode 170*b* through the via hole 181. Here, the present invention has described the case where the first electrode layer 190 acts as an anode for ease of explanation, but the first electrode layer 190 can act as a cathode. The first electrode layer 190 may be formed as a transparent electrode with indium-tin-oxide (ITO) or other like materials for a bottom emitting display, and it may be formed as a reflective electrode, such as with Al/Ca and a transparent electrode such as ITO, in the case of a front emissive display type. In this manner, the first electrode layer 190 can be formed of a variety of materials.

The protection layer 180 may also be formed of a variety of materials, such as an inorganic or organic material, and in a variety of configurations, such as a single layer or a double layer in which the lower layer includes SiNx and the upper layer is an organic layer including benzocyclobutene (BCB) or acryl.

A pixel defining layer 191, having a pixel aperture 194, may be formed on an upper part of the protection layer 180. The pixel aperture 194 is a region that corresponds to the first electrode layer 190. An intermediate layer 192, which includes at least an emission layer, may be disposed on a surface of the first electrode layer 190, and a second electrode layer 400 may be formed on an entire upper surface of the intermediate layer 192.

The intermediate layer 192 can be formed of a low molecular organic film or polymer organic film. If formed of a low molecular organic film, the intermediate layer 192 may include a Hole Injection Layer (HIL), a Hole Transport Layer (HTL), an Emission Layer (EML), an Electron Transport Layer (ETL), and an Electron Injection Layer (EIL) that can be stacked to a single structure or a composite structure, and organic materials that may be used include copper phthalocyanine (CuPc), N,N'-Di(naphthalene-1-yl)-N,N'-diphenylbenzidine (NPB), and tris-8-hydroxyquinoline aluminum (Alq3). The low molecular organic film can be formed by an evaporation method.

If the intermediate layer 192 is formed of a polymer organic film, it may include a HTL and an EML, where the HTL may be formed of PEDOT, and the EML may be formed of Poly-Phenylenevinylene (PPV) and Polyfluorene. The polymer organic film can be formed by various methods, including a screen printing method or an ink jet printing method.

The second electrode layer 400, as a cathode, may be deposited on the entire surface of the intermediate layer 192, but is not limited thereto. The second electrode layer 400 can be formed of materials such as Al/Ca, ITO, and Mg—Ag. Further, it may be formed in many different forms, such as having multiple layers or further including an alkali or alkali earth fluoride layer, such as a LiF layer.

As shown in FIG. 2B and FIG. 2C, the organic EL display device, according to exemplary embodiments of the present invention, may further include an auxiliary driving line 310*b*, which is coupled with a driving line 310*a* through a via hole 211 and is in a different layer from the driving line 310*a*.

The driving line 310*a*, which supplies driving power to each of the pixels in the display region 200, may be disposed across the display region 200. The driving line 310*a*, which is formed in the same layer as the source/drain electrodes 170*a* and 170*b*, may be formed simultaneously with the source/drain electrodes 170*a* and 170*b*.

As FIG. 2C shows, the auxiliary driving line 310*b* may be formed of the same layer as the first electrode layer 190. The first electrode layer 190 is patterned through wet etching after being formed through a process such as sputtering. The auxiliary driving line 310*b* can be formed simultaneously with the first electrode layer 190 by masking appropriately with respect to a portion of the substrate for forming the auxiliary driving line 310*b*.

Figure 2D:
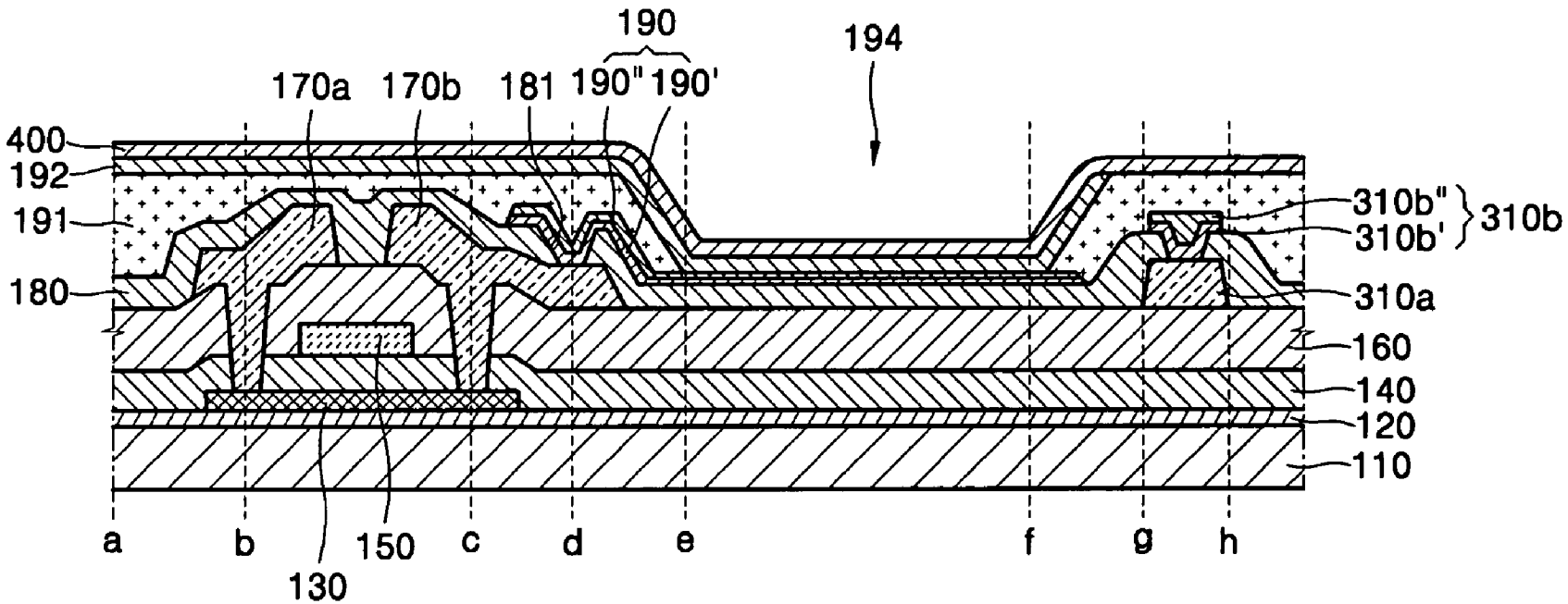

If the first electrode layer 190 is used as an anode of a frontal emissive type organic EL display device, it may include more than two layers. As FIG. 2D shows, the first electrode layer 190 can include a reflection electrode 190', formed of Mg:Ag or Al for reflecting light toward the substrate, and a transparent electrode 190", formed of ITO having an appropriate work function to be able to discharge holes easily. In this case, the reflection electrode 190' may be approximately 1000-3000 Å thick, and the transparent electrode 190" may be approximately 125-250 Å thick.

In this case, the auxiliary driving line 310*b* may include a layer which is formed simultaneously with at least one of the first electrode's layers. The auxiliary driving line 310*b* may include the same number of layers as the first electrode layer 190 to prevent a manufacturing process problem, such as disconnection, and to secure an increased conductivity. As FIG. 2D shows, when the first electrode layer 190 comprises the reflection electrode 190' and the transparent electrode 190", the auxiliary driving line 310*b* may comprise a first auxiliary driving line layer 310*b'* and a second auxiliary driving line layer 310*b"*.

Figure 3A:
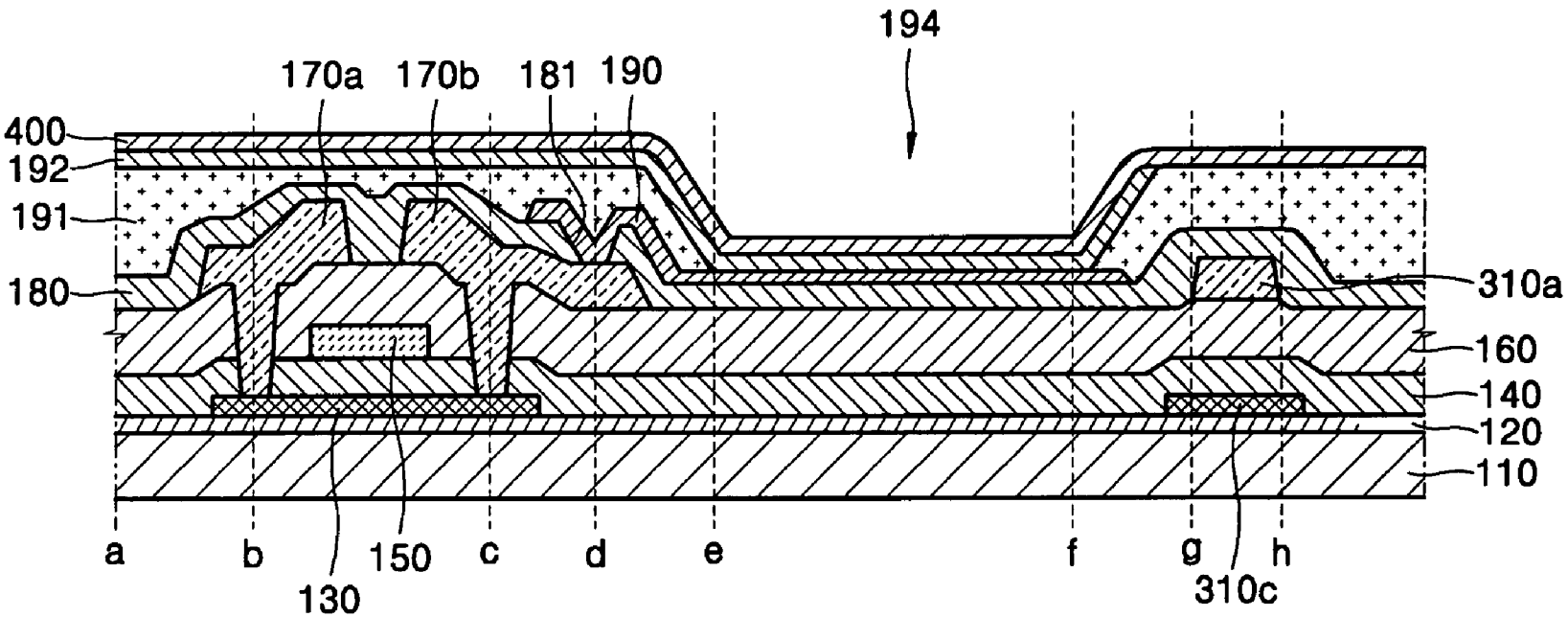
FIG. 3A and FIG. 3B are cross-sectional views showing an organic EL display device according to an exemplary embodiment of the present invention.

Alternatively, according to another exemplary embodiment of the present invention shown in FIG. 3A, an auxiliary driving line 310*c* may be formed of the semiconductor active layer 130 instead of the first electrode layer 190. This is advantageous since it does not require an additional process, and the auxiliary driving line 310*c* can be formed when patterning the semiconductor active layer 130.

Figure 3B:
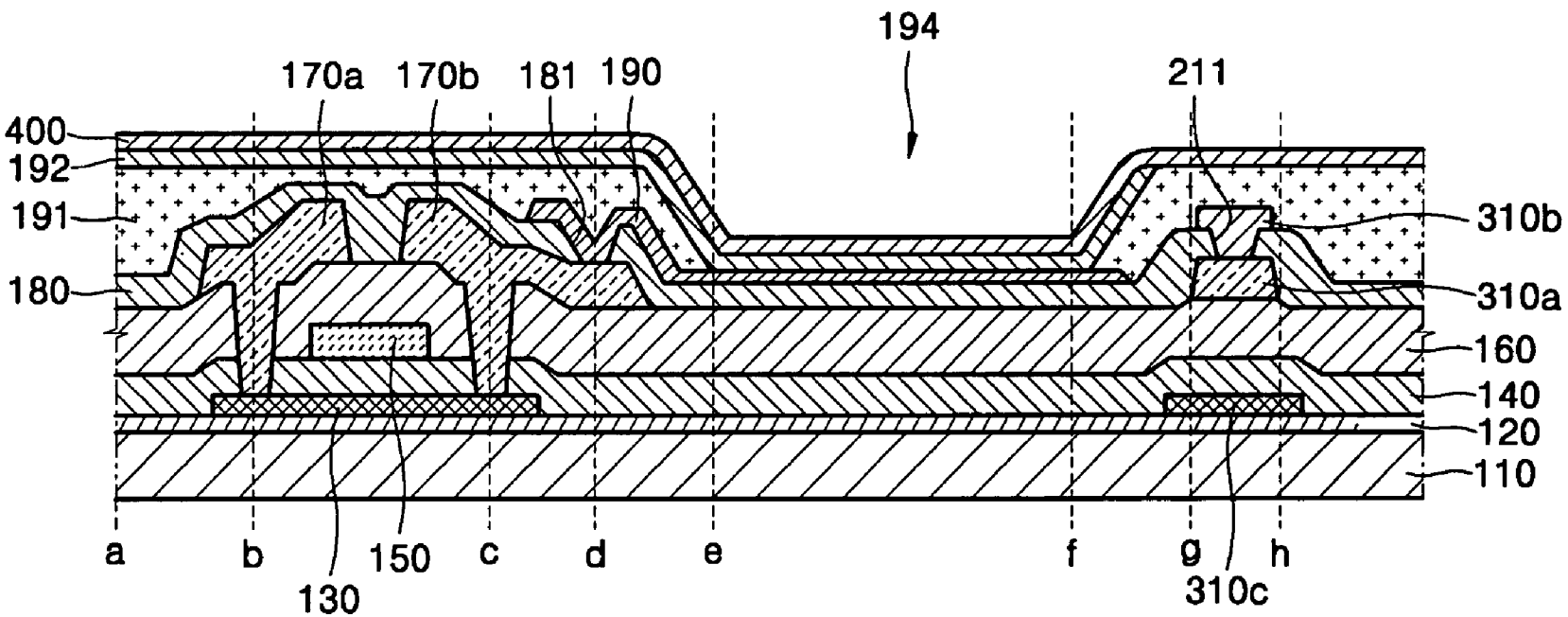

Also, according to another exemplary embodiment of the present invention shown in FIG. 3B, the auxiliary driving line may comprise two or more lines. For example, the auxiliary driving line may include a first auxiliary driving line 310*b* formed simultaneously with the first electrode layer 190, and a second auxiliary driving line 310*c* formed simultaneously with the semiconductor active layer 130. Hence, when formed simultaneously with the source/drain electrodes 170*a* and 170*b*, the driving line 310*a* is disposed therebetween. Further, if the first electrode layer 190 comprises a multiple electrode layer, the first auxiliary driving line 310*b* formed simultaneously with the first electrode layer 190 can also be formed as a multiple conductive layer.

Additionally, at least one via hole can be formed in an insulating layer interposed between the driving line 310*a* and the auxiliary driving lines 310*b* and 310*c* for coupling them with each other, and the via holes can be formed at least between two lines of the driving line and the auxiliary driving lines. That is, the electrical connection among the driving lines through the via holes can be made between the driving line and the auxiliary driving lines, and between the auxiliary driving lines. The via holes may be formed in the display region in order to improve the brightness uniformity of a large screen.

Figure 4A:
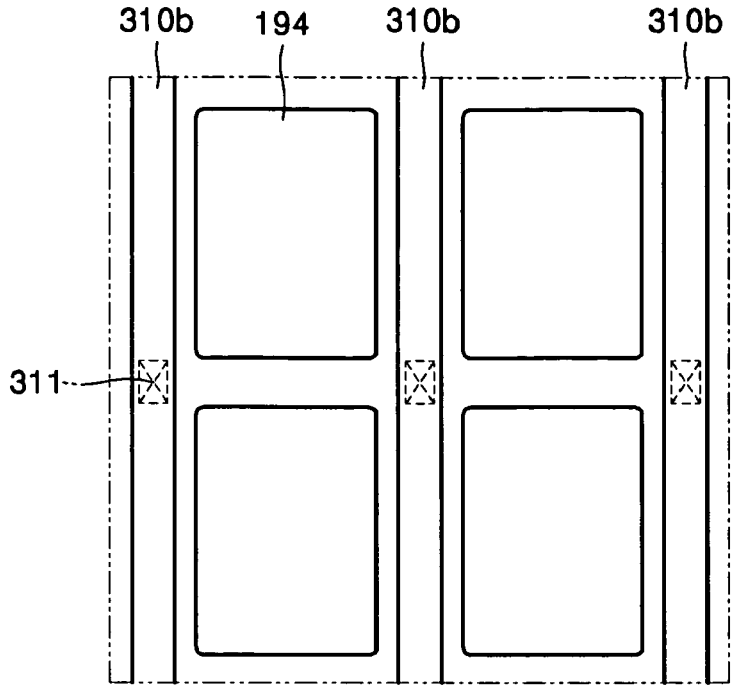
FIG. 4A, FIG. 4B, FIG. 4C, FIG. 4D, FIG. 4E, FIG. 4F and FIG. 4G are partial plan views showing an organic EL display device according to exemplary embodiments of the present invention.
Figure 4B:
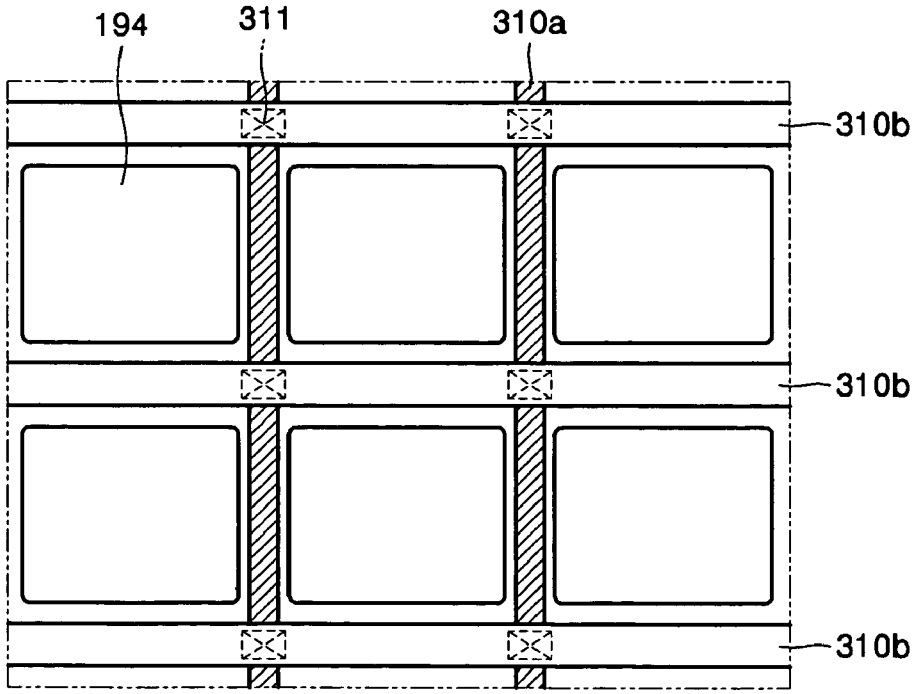

The auxiliary driving line may be formed in numerous forms. For example, as FIG. 4A and FIG. 4B show, the auxiliary driving lines 310*b* can be disposed in a stripe shape parallel to the driving line 310*a*, or they can be disposed orthogonal to the driving line 310*a*. In FIG. 4A, the auxiliary driving lines 310*b* cover the driving lines 310*a*.

Figure 4C:
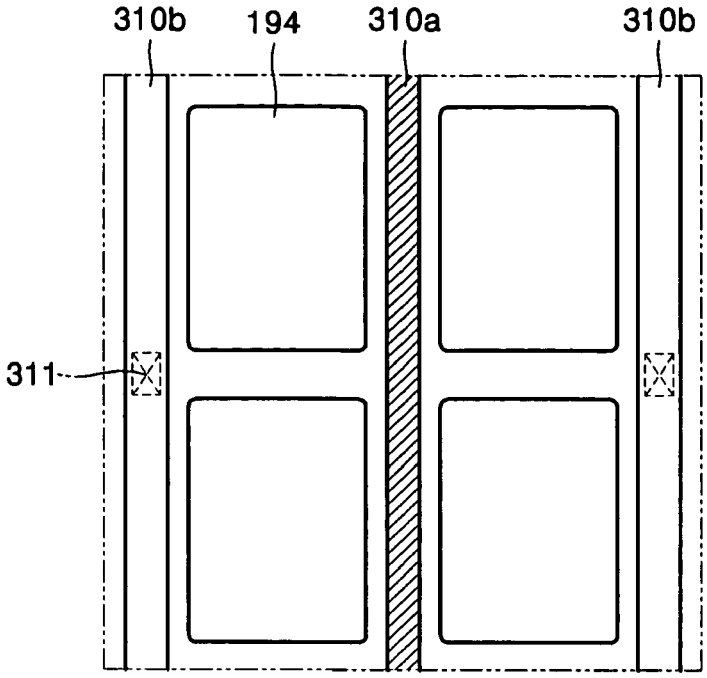

While FIG. 4A and FIG. 4B show one pixel line disposed between adjacent auxiliary driving lines 310*b*, more than one pixel line may be disposed between adjacent auxiliary lines. For example, FIG. 4C shows two pixel lines disposed between adjacent auxiliary driving lines 310*b*.

Figure 4D:
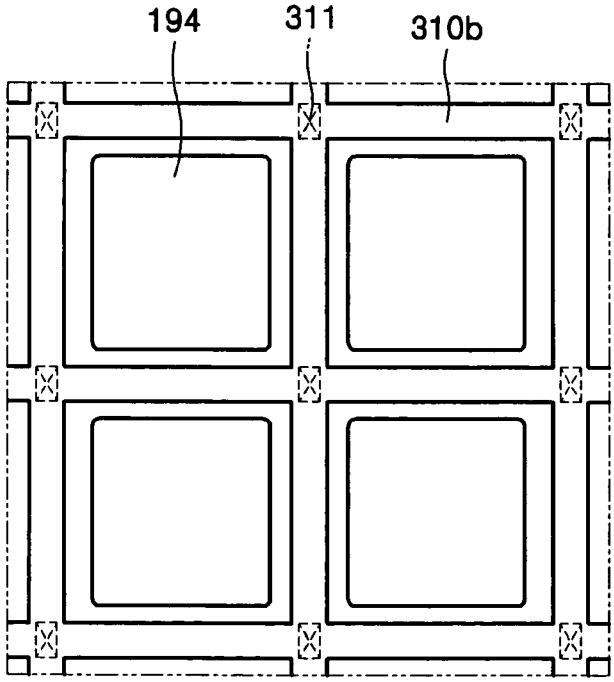
Figure 4E:
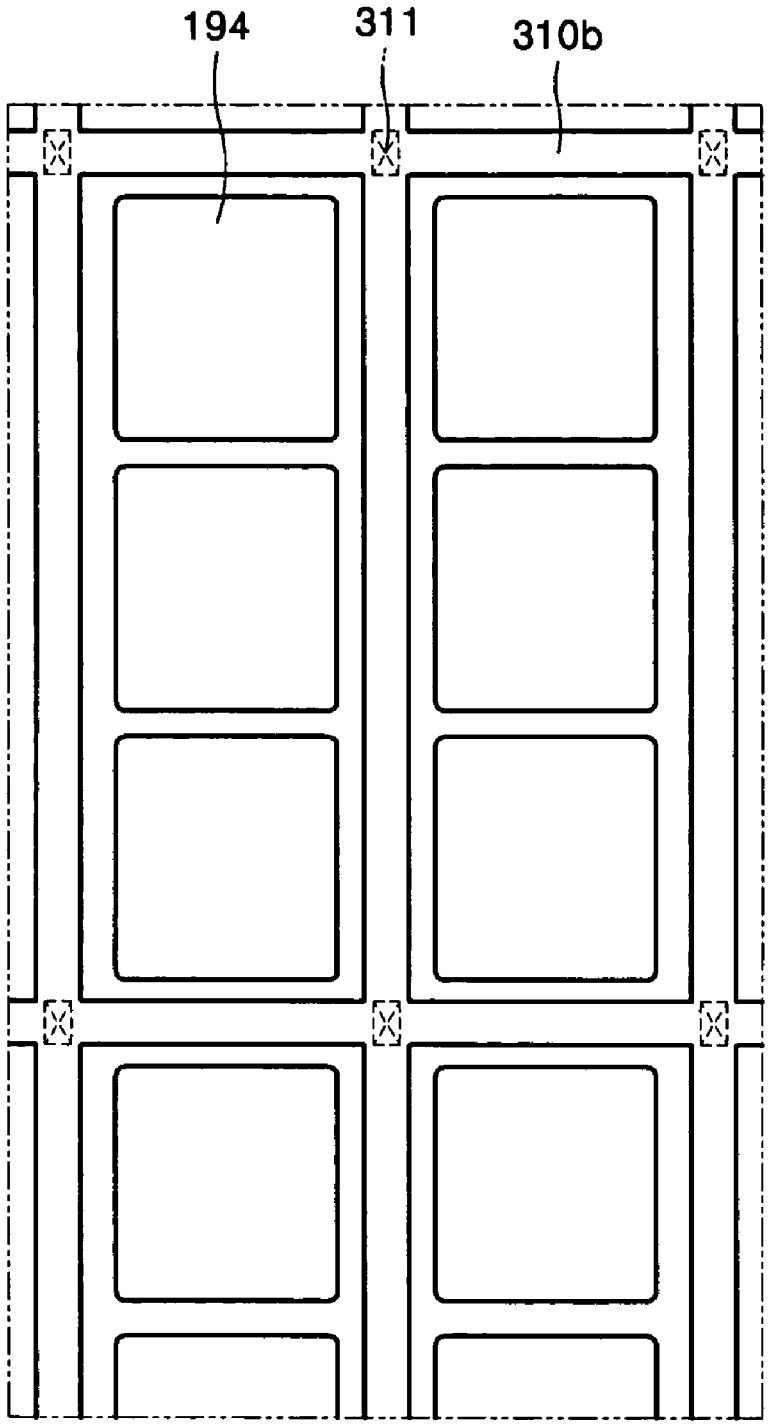

FIG. 4D shows an exemplary embodiment of the present invention where at least a portion of the auxiliary driving line 310*b* is disposed in a mesh shape to supply driving power more smoothly to the display region. As FIG. 4E shows, more than two pixels may be disposed in the mesh region formed by the mesh shaped auxiliary driving lines 310*b*, which may simplify a manufacturing process.

Figure 4F:
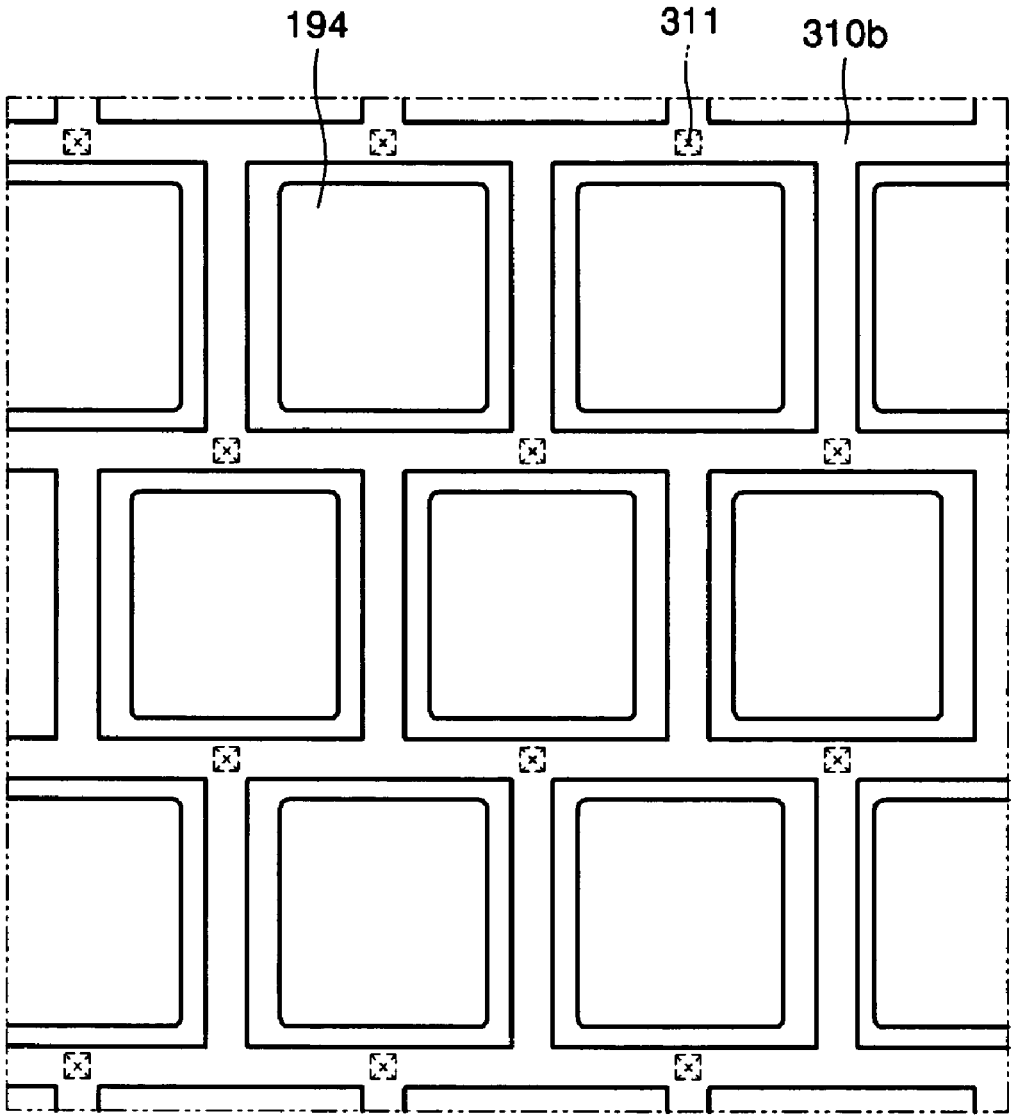

Additionally, as FIG. 4F shows, the pixels can be arranged in a delta shape. In this case, the auxiliary driving line 310*b* may also be disposed in the delta shape.

Figure 4G:
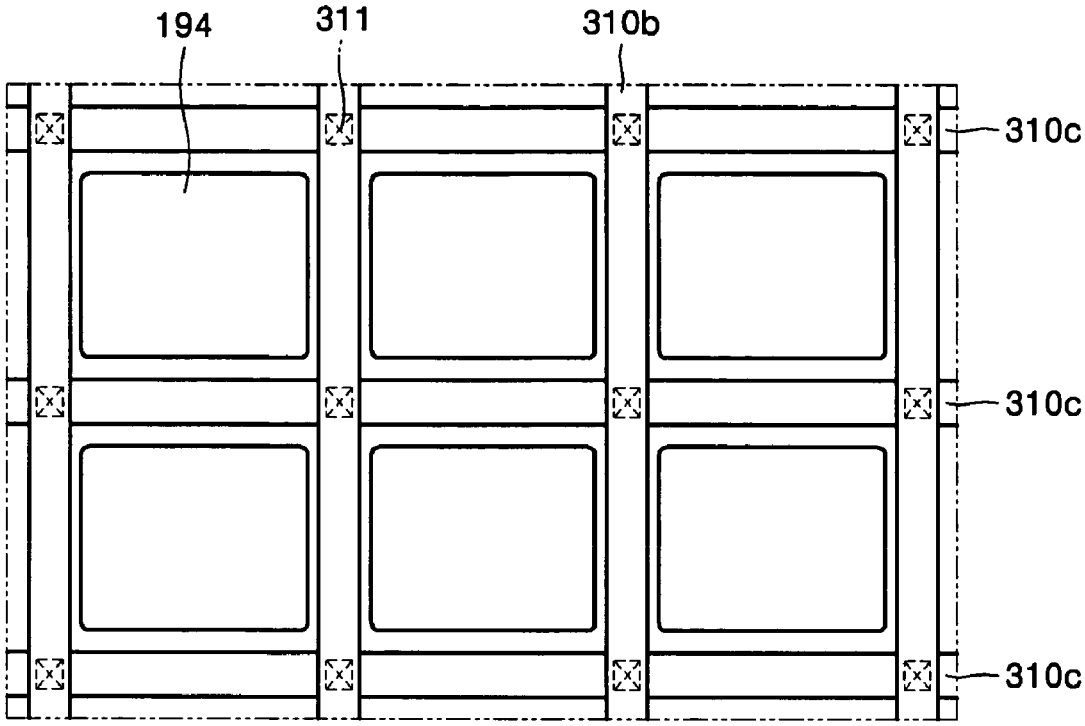

FIGS. 4A through 4F show the auxiliary driving lines formed of a single auxiliary driving line 310*b*. But the present invention is not limited thereto, and the auxiliary driving lines can be formed of two or more lines. For example, as FIG. 4G shows, the first auxiliary driving line 310*c*, which is formed simultaneously with the semiconductor active layer 130, and the second auxiliary driving line 310*b*, which is formed simultaneously with the first electrode layer 190, can be of various shapes which are similar to the patterns depicted in FIGS. 4A through 4F. Further, the first auxiliary driving line 310*c* and the second auxiliary driving line 310*b* can be formed in a stripe shape, and they may be disposed alternately with each other. Additionally, the via holes coupling the auxiliary driving lines or coupling the driving line and the auxiliary driving line can be disposed in the display region.

The present invention is not limited to the exemplary embodiments described above. That is, although the present invention is described with respect to an organic EL display device, it can also be applied to other display devices, such as an inorganic EL display device. Hence, the embodiments of present invention can be modified in a variety of forms with respect to a flat display device that includes an auxiliary driving line.

According to exemplary embodiments of the present invention, a driving line's width may be significantly reduced by including an auxiliary driving line or lines, thereby improving image quality by increasing the pixels' aperture ratio.

Further, including at least one auxiliary driving line for supplying driving power to the display device may reduce the voltage drop of the driving power in different locations on a display region, thereby improving image quality.

Additionally, the auxiliary driving lines may be arranged in a variety of layouts according to design specification, thereby providing a flat display device with appropriately shaped auxiliary driving lines.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A flat display device having a display region including at least two thin film transistors and a pixel, comprising:

a scan line electrically connected with a gate electrode of a first thin film transistor;

a data line electrically connected with either a source electrode or a drain electrode of the first thin film transistor;

a first electrode electrically connected with either a source electrode or a drain electrode of a second thin film transistor;

a driving line that supplies uniform power to the display region;

an auxiliary driving line electrically connected with the driving line;

an intermediate layer comprising at least an emission layer; and a second electrode, wherein the auxiliary driving line and the driving line are in a different layer from each other, the auxiliary driving line being formed directly on the same layer as the first electrode, the driving line being formed directly on the same layer as the source electrode and the drain electrode, wherein each end of the driving line is coupled to a driving power supply line, wherein the intermediate layer is disposed between the first electrode and the second electrode, wherein a light emitting unit comprises the first electrode, the intermediate layer, and the second electrode, and the first electrode is either an anode or a cathode of the light emitting unit, and wherein the driving line is electrically connected with the first electrode to supply uniform power to the light emitting unit.

2. The flat display device of claim 1, wherein the driving line is formed by a same material as the source electrode and the drain electrode of the thin film transistor.

3. The flat display device of claim 1, wherein the auxiliary driving line is formed by a same material as the first electrode.

4. The flat display device of claim 1, wherein the first electrode comprises two conductive layers and the auxiliary driving line includes at least one layer that is formed simultaneously with a layer of the first electrode.

5. The flat display device of claim 1, wherein at least a portion of the auxiliary driving line is disposed parallel to the driving line.

6. The flat display device of claim 1, wherein at least a portion of the auxiliary driving line is disposed in a stripe shape.

7. The flat display device of claim 6, wherein at least a portion of the auxiliary driving line is parallel to the driving line.

8. The flat display device of claim 6, wherein at least a portion of the auxiliary driving line is disposed with every other driving line.

9. The flat display device of claim 6, wherein the auxiliary driving line comprises a first auxiliary driving line and a second auxiliary driving line, and wherein at least one driving line is disposed between the first auxiliary driving line and the second auxiliary driving line.

10. The flat display device of claim 1, wherein at least a portion of the auxiliary driving line is disposed in a mesh shape.

11. The flat display device of claim 10, wherein the mesh shape forms mesh regions and at least one pixel is disposed in at least one mesh region.

12. The flat display device of claim 1, wherein at least a portion of the auxiliary driving line is disposed in a delta shape.

13. The flat display device of claim 1, wherein via holes are formed in at least one insulating layer to couple the driving line with the auxiliary driving line, and the via holes are disposed in the display region.

14. The flat display device of claim 1, wherein an electroluminescent unit is included in the pixel of the display region.

15. The flat display device of claim 1, wherein the first electrode directly contacts either the source electrode or the drain electrode.

16. An electroluminescent display device having a display region including at least two thin film transistors and an intermediate layer, the intermediate layer including at least an emission layer and being interposed between a first electrode and a second electrode, the first electrode being electrically connected with either a source electrode or a drain electrode of a second thin film transistor, comprising:

a scan line electrically connected with a gate electrode of a first thin film transistor;

a data line electrically connected with either a source electrode or a drain electrode of the first thin film transistor;

a driving line that supplies uniform power to the display region; and an auxiliary driving line electrically connected with the driving line, wherein the driving line and the auxiliary driving line are in different layers from each other, the auxiliary driving line being formed directly on the same layer as the first electrode, the driving line being formed directly on the same layer as the source electrode and the drain electrode of the second thin film transistor, and wherein each end of the driving line is coupled to a driving power supply line.

17. The electroluminescent display device of claim 16, wherein the first electrode directly contacts either the source electrode or the drain electrode.

* * * * *